United States Patent [19]

Vadasz F. et al.

[11] Patent Number: 5,048,604

[45] Date of Patent: Sep. 17, 1991

[54] SUCKER ROD ACTUATED INTAKE VALVE ASSEMBLY FOR INSERT SUBSURFACE RECIPROCATING PUMPS

[75] Inventors: Amnon M. Vadasz F., San Antonio de Los Altos; Jesus E. Chacin U., Caracas, both of Venezuela

[73] Assignee: Intevep, S.A., Caracus, Venezuela

[21] Appl. No.: 610,055

[22] Filed: Nov. 7, 1990

[51] Int. Cl.[5] ..... E21B 34/14; F04B 47/00

[52] U.S. Cl. ..... 166/106; 166/325; 166/373; 166/386; 417/448; 417/450; 417/451; 417/454

[58] Field of Search ..... 166/386, 373, 105, 106, 166/108, 325; 417/448, 450, 444, 454, 451

[56] References Cited

U.S. PATENT DOCUMENTS

| | | | |
|---|---|---|---|
| 480,265 | 8/1892 | Jones | 417/448 |
| 1,020,337 | 3/1912 | Wilkinson | 417/451 |
| 1,067,496 | 7/1913 | Wilkinson | 417/451 |
| 1,146,312 | 7/1915 | Davis | 417/448 |
| 1,676,186 | 7/1928 | Hawkins | 417/451 |
| 2,111,176 | 3/1938 | Cox | 417/450 |

*Primary Examiner*—Bruce M. Kisliuk

*Attorney, Agent, or Firm*—Bachman & LaPointe

[57] ABSTRACT

The invention is drawn to an improved inlet valve assembly for use in subsurface sucker rod operated reciprocating piston pumps. The inlet valve or standing valve is locked in the closed position when the pump is unanchored from the production tubing to prohibit passage of fluid into the pump barrel.

4 Claims, 1 Drawing Sheet

SUCKER ROD ACTUATED INTAKE VALVE ASSEMBLY FOR INSERT SUBSURFACE RECIPROCATING PUMPS

BACKGROUND OF THE INVENTION

The present invention is drawn to an improved inlet valve assembly for use in subsurface sucker rod operated reciprocating piston pumps used in the petroleum industry for pumping oil from a downhole well to the surface.

Typically, subsurface sucker rod operated reciprocating piston pumps comprise a pump barrel having any inlet check valve and an outlet check valve and a pump plunger which is reciprocated within the barrel via a sucker rod. The intake valve is generally located at the entrance to the pump barrel and allows for the flow of well fluids into the pump barrel. The discharge valve is commonly located in the plunger and permits the flow of well fluids out of the pump barrel and up to the surface. Upon reciprocation of the pump plunger by the sucker rod, the coordinated action of both the intake valve and the discharge valve results in fluid flow from the well to the surface.

In order for the reciprocating piston pumps to operate properly they must be anchored within the production tube of the deep well. Thus, during normal pumping operations from the well the reciprocating piston pump is anchored within the production tube. However, during well maintenance, repair and stimulation operations, such as, steam injection or diluent injection, it is necessary to stop the normal pumping operation and to remove the subsurface reciprocating pump from its anchored position in the production tube as no fluids could flow down through the pump when in its anchored position. While the pump must be unanchored in order to carry out fluid injection and the like as aforesaid, it is highly desirable that the reciprocating piston pump remain within the production tube in order to avoid the cost and lost time associated with bringing the subsurface reciprocating pump and sucker rod string to the surface during the aforesaid operations. Accordingly, it is common practice in the prior art to unanchored the subsurface reciprocating pump by pulling the sucker rod string from the surface and move the pump a short distance from its anchored position to an enlarged section of the production tube. In this position, specific fluids from the surface can be injected downhole into the well for maintenance, repair and recovery stimulation.

During the injection of the aforesaid fluids into the well it is extremely important not to allow any flow through the pump barrel of the subsurface reciprocating pump as the fluids being injected generally carry particles which are known to damage the pump plunger and pump barrel surfaces. Accordingly, in existing systems one must choose between removing the reciprocating pump entirely from the production tube or suffer the consequences of passing a portion of the aforesaid injected fluid through the pump barrel of the pump thus resulting in the aforesaid damage to same.

Naturally, it would be highly desirable to provide a system wherein the reciprocating piston pump may be maintained in the production tube of a downhole well and at the same time insure that no fluids which would damage the pump will pass through the pump during the maintenance, repair and stimulation operations as set forth above.

Accordingly, it is the principal object of the present invention to provide an improved inlet valve assembly for use in subsurface sucker rod operated reciprocating piston pumps.

It is a particular object of the present invention to provide an intake valve assembly as aforesaid wherein the inlet valve to the reciprocating piston pump is locked in its closed position when the pump is in its unanchored, non-pumping position within the production tube of a deep well.

It is a further object of the present invention to provide an inlet valve assembly as aforesaid wherein the inlet valve is freely moveable between its open and closed position when anchored within the production tube of the deep well for pumping fluid from the well to the surface.

It is a further object of the present invention to provide an inlet valve assembly as aforesaid which is effective in service and relatively inexpensive to manufacture.

Further objects and advantages of the present invention will appear hereinbelow.

SUMMARY OF THE INVENTION

In accordance with the present invention the foregoing objects and advantages readily obtained.

The present invention is drawn to an improved inlet valve assembly for use in combination with a sucker rod operated reciprocating subsurface pump which is disposed within the production tube of a deep well for pumping oil from the well to the surface. In accordance with the present invention the sucker rod operated reciprocating subsurface pump is selectively positioned between a first position wherein the pump is anchored in the production tube for pumping fluid from the well and a second position wherein said pump is unanchored in said production tube for non-pumping operations such as maintenance, repair and recovery stimulation operations. The reciprocating subsurface pump comprises a pump barrel having a first valve seat defining an inlet to the pump barrel and a second valve seat defining an outlet port from the valve barrel. An inlet valve is provided for selectively sealing the inlet port by seating on a surface of the first valve seat. Likewise, an outlet valve is provided for selectively sealing the outlet port from the valve barrel. A pump plunger is mounted for reciprocal movement via a sucker rod within the pump barrel for pumping fluid from the inlet port to the outlet port when the pump is anchored in the production tube. In accordance with the present invention, the pump plunger includes means for (1) locking the inlet valve against the inlet port for sealing same against pressure downhole in the well when the pump is in its second unanchored position so as to prohibit passage of fluid into the pump barrel and (2) unlocking the inlet valve so as to allow for selective sealing and unsealing of the inlet port to the pump barrel when the pump is in its first anchored position for pumping fluid from the well.

In accordance with of the present invention the mechanism for locking the inlet valve includes a mechanical biasing mechanism which biases the inlet valve against the inlet port. The mechanism includes a cylinder carried by the pump plunger, a piston positioned within the cylinder and a spring for biasing the piston out of the cylinder for contacting the inlet valve.

By providing an arrangement as aforesaid the sucker rod operated reciprocating subsurface pump may be maintained within the production tube when in its unanchored position without fear of fluid passing through the inlet valve and through the pump barrel and damaging same.

DETAILED DESCRIPTION

Figure 2:
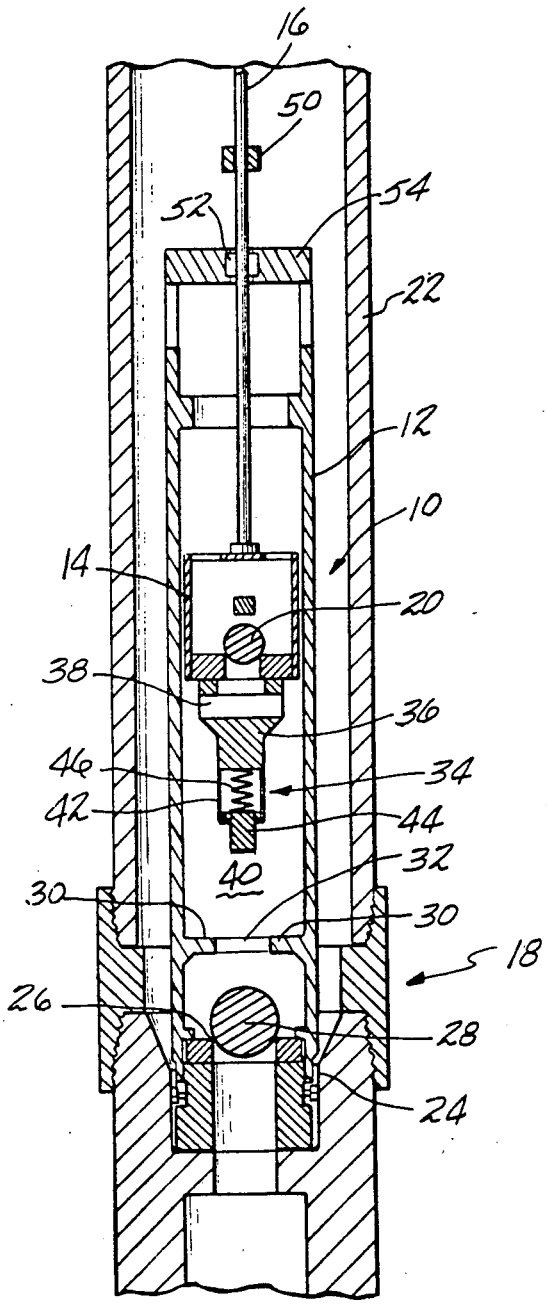
FIG. 2 is a partial cross sectional view similar to FIG. 1 showing the subsurface pump in its anchored position within the production tube wherein the inlet valve is free to move between its open and closed positions.
Figure 1:
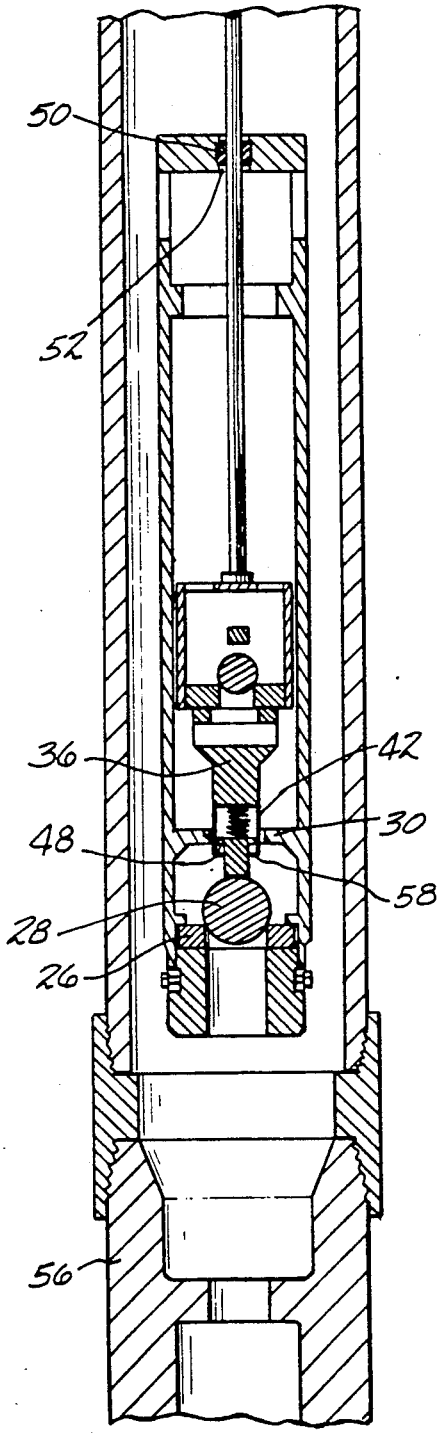
FIG. 1 is a partial sectional view of a deep well pump assembly in its unanchored position in the production tube and illustrating an inlet valve of the present invention in its locked position.

With reference to FIGS. 1 and 2 there is illustrated a sucker rod operated reciprocating subsurface pump 10 located within the production tube 22 of a deep well. The reciprocating subsurface pump 10 comprises a pump barrel 12 having a plunger 14 mounted therein for reciprocal movement via sucker rod 16. Pump barrel 12 is provided with an inlet valve assembly 18 for drawing fluid into the pump barrel during the upward stroke of the pump plunger 14 via sucker rod 16. The pump plunger 14 carries a discharge valve 20 which opens for passing fluid from the pump barrel and up well production tube 22 on the downward stroke of the pump plunger 14.

The inlet valve assembly 18 includes a valve seat 24 formed within the pump barrel 12 and defines a sealing surface 26 upon which valve seating element 28 seals when in its closed position. A pair of flanges 30 which define an opening 32 are located above valve seating element 28 and act as a stop for the valve seating element 28.

In accordance with the present invention, a locking mechanism 34 is fixed to the pump plunger 14. The locking mechanism 34 comprises a first stud-like member 36 which is provided with fluid passage 38 for communicating the interior 40 of pump barrel 12 with the discharge valve 20 carried by the pump plunger 14. Located on the end of stud 36 is a cylinder 42 which receives therein piston member 44 which is biased by spring element 46 so as to extend from the cylinder 42. The piston 44 is provided with a circumferential lip 48 which rests against a corresponding lip 58 provided on cylinder member 42 when the piston is in its fully extended position under the influence of spring 46.

Sucker rod 16 is provided with an engagement means in the form of a "J" latch-type device 50 which is adapted to engage a corresponding annular cutout 52 provided in the backwall 54 of pump barrel 12. As can best be seen in FIG. 1, when it is desired to unseat the pump barrel 12 from its anchored position within the production tube 22 the "J" latch-type element 50 on the sucker rod is lowered and turned so as to engage in cutout 52 in the backwall 54 pump barrel 12. Once engagement is made the sucker rod can be lifted and with it comes the pump 10 which is unseated from its anchored position within seating nipple 56. Again, as can be seen in FIG. 1, when the sucker rod is lowered so as to engage element 50 within cutout 52 the locking mechanism 54 is lowered through opening 32 and piston 44 under the influence of spring 46 is biased against valve seating element 28 so as to hold the valve seating element 28 on the sealing surface 26 of valve seat 24. In this manner, it is assured that fluid will not enter the pump barrel when the pump is in its unanchored position and the well is being serviced.

When maintenance of the well is complete the sucker rod 16 may be lowered so as to seat the pump barrel in the seating nipple 56 and element 50 is thereafter disengaged from element 52 so as to allow for the valve seating element 20 to be freely moved between its closed and open position upon reciprocating of pump plunger 14 via the sucker rod 16.

Accordingly, the deep well pump of the present invention is provided with a mechanism which insures that the valve remains in its sealed position against the pressures which will be created downhole in the well during servicing, maintenance and the injection of fluids for well stimulation.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a deep well having a production tube and a sucker rod operated reciprocating subsurface pump which is selectively positioned between a first position wherein said pump is anchored in said production tube for pumping fluid from the well and a second position wherein said pump is unanchored in said production tube for non-pumping operations wherein said pump comprises a pump barrel having first valve seat defining an inlet port and a second valve seat defining an outlet port, an inlet valve for selectively sealing said inlet port and an outlet valve for selectively sealing said outlet port and a plunger reciprocally mounted within said pump barrel for pumping fluid from said inlet port to said outlet port, the improvement which comprises locking means carried by said plunger for biasing said inlet valve for locking said inlet valve against said inlet port and sealing same against pressure downhole in the well when said pump is in said second position so as to prohibit passage of fluid into said pump barrel and unlocking said inlet valve so as to allow for selective sealing and unsealing of the inlet port when said pump is in said first position for pumping fluid from said well.

2. A system according to claim 1, wherein said locking means comprises a cylinder having an open end, a piston positioned within said cylinder and biasing means or biasing said piston through said open end.

3. A system according to claim 2, wherein said piston contacts said inlet valve when said pump is in said second position.

4. A system according to claim 2, wherein said sucker rod includes engaging means for securing said pump barrel thereto when said pump is in said second position.

* * * * *